US006928752B2

(12) United States Patent
Johnson et al.

(10) Patent No.: US 6,928,752 B2
(45) Date of Patent: Aug. 16, 2005

(54) COMBINATION TUMBLE AND CABINET DRYER

(75) Inventors: Troy A. Johnson, Newton, IA (US); Lee R. Birch, Altoona, IA (US); Michael C. Roberts, Bastrop, TX (US); Kevin W. Shipley, Newton, IA (US); Julie M. Bundy, Ankeny, IA (US); Frank S. Nekic, Newton, IA (US); Stephen D. Schober, Newton, IA (US); Curtis J. Tremel, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/406,814

(22) Filed: Apr. 4, 2003

(65) Prior Publication Data

US 2004/0194339 A1 Oct. 7, 2004

(51) Int. Cl.[7] ..... F26B 11/02

(52) U.S. Cl. ..... 34/595; 34/109; 34/201; 34/127; 34/603; 34/138; 34/622; 34/192; 34/197

(58) Field of Search ..... 34/595, 108, 103, 34/90, 109, 201, 127, 130, 260, 261, 264, 129, 128, 131, 132, 596, 600, 602, 603, 604, 134, 138, 139, 622, 192, 195–197

(56) References Cited

U.S. PATENT DOCUMENTS

| | | | | |
|---|---|---|---|---|
| 2,443,069 A | | 6/1948 | Gayring | |
| 2,870,545 A | * | 1/1959 | Richterkessing | 34/63 |
| 3,197,886 A | | 8/1965 | Brame et al. | |

(Continued)

FOREIGN PATENT DOCUMENTS

| | | |
|---|---|---|
| EP | 0 758 694 A1 | 2/1997 |
| EP | 0816552 A3 | 1/1998 |

(Continued)

OTHER PUBLICATIONS

Sharp Press Release Feb. 19, 2001 Sharp Introduces Two new Dehumidifiers for Fiscal 2001 DW–M16 is Industry's First "Plasma Cluster" Laundry drying dehumidifier, DW–M16G is New Fast–Drying Laundry Dehumidifier; Cluster Ions Catch Bacteria and Odor 16–Liter/Day Moisture Removal Capacity means Fast Drying.

The Laundry Alternative, Inc. web site.

Wet Cleaning Equipment Report by Anthony Star and Cindy Vasquez, May 1997.

628–01–02: Total Laundry Solution (TLS) Australian Design Awards web page.

*Primary Examiner*—Henry Bennett
*Assistant Examiner*—Andrea M. Ragonese
(74) *Attorney, Agent, or Firm*—McKee, Voorhees & Sease, PLC; Bruce P. Watson

(57) ABSTRACT

A combination tumble and cabinet dryer appliance includes a housing with a tumble dryer and a cabinet dryer therein. The tumble dryer and cabinet dryer are operable independently of one another. Separate sources of hot air are provided to each of the tumble and cabinet dryers. The cabinet dryer extends over and along one side of the tumble dryer. A portion of the cabinet dryer extends substantially along the height of the housing so as to receive long hanging clothes, such as a dress. Removable shelves are provided in the cabinet dryer for drying sweaters and the like.

29 Claims, 7 Drawing Sheets

U.S. PATENT DOCUMENTS

| | | | | | |
|---|---|---|---|---|---|
| 3,256,616 | A | | 6/1966 | McGoldrick | |
| 3,417,481 | A | | 12/1968 | Rumsey, Jr. | |
| 3,594,917 | A | | 7/1971 | Montgomery | |
| 3,601,292 | A | | 8/1971 | Bliss | |
| 3,670,425 | A | | 6/1972 | Benjamin et al. | |
| 3,712,086 | A | | 1/1973 | Payet et al. | |
| 3,739,496 | A | | 6/1973 | Buckley et al. | |
| 3,805,561 | A | | 4/1974 | Bullock | |
| 3,849,815 | A | | 11/1974 | Frauendorf | |
| 4,304,053 | A | | 12/1981 | Kellerhals et al. | |
| 4,625,432 | A | | 12/1986 | Baltes | |
| 4,819,341 | A | | 4/1989 | Gayso | |
| 4,934,559 | A | * | 6/1990 | Putnam | 220/377 |
| 5,094,020 | A | | 3/1992 | Wingfield et al. | |
| 5,107,603 | A | | 4/1992 | Durazzani | |
| 5,152,077 | A | | 10/1992 | Liang | |
| 5,305,484 | A | | 4/1994 | Fitzpatrick et al. | |
| 5,369,892 | A | | 12/1994 | Dhaemers | |
| 5,516,012 | A | | 5/1996 | Weigel | |
| 5,555,640 | A | * | 9/1996 | Ou | 34/202 |
| 5,730,006 | A | | 3/1998 | Conley | |
| 5,815,961 | A | | 10/1998 | Estes et al. | |
| 5,859,778 | A | * | 1/1999 | Kuroda et al. | 364/474.11 |
| 5,870,836 | A | * | 2/1999 | Grimes | 34/202 |
| 5,987,773 | A | * | 11/1999 | Lipscy | 34/106 |
| 5,996,249 | A | | 12/1999 | Manning | |
| 6,005,227 | A | * | 12/1999 | Pappas | 219/400 |
| 6,018,885 | A | * | 2/2000 | Hill | 34/202 |
| 6,189,346 | B1 | | 2/2001 | Chen et al. | |
| 6,263,591 | B1 | | 7/2001 | La Porte | |
| 6,363,627 | B1 | | 4/2002 | Lai | |
| 6,425,192 | B2 | | 7/2002 | Arrieta et al. | |
| 2002/0017117 | A1 | * | 2/2002 | Sunshine et al. | 68/3 R |

FOREIGN PATENT DOCUMENTS

| | | | |
|---|---|---|---|
| EP | 0816552 | B1 | 1/1998 |
| GB | 2 238 322 | A | 5/1991 |
| GB | 2 289 752 | A | 11/1995 |
| GB | 2 321 954 | A | 12/1998 |
| GB | 2 345 493 | A | 12/2000 |
| JP | 01-303199 | | 7/1989 |
| JP | 63-135332 | | 7/1989 |
| JP | 3207399 | | 9/1991 |
| JP | 3289999 | | 12/1991 |
| JP | 404084998 | A | 3/1992 |
| JP | 4126198 | | 4/1992 |
| JP | 404156896 | A | 5/1992 |
| JP | 19900269123 | | 5/1992 |
| JP | 404187194 | A | 7/1992 |
| JP | 5208096 | | 8/1993 |
| JP | 405208096 | A | 8/1993 |
| JP | 406339598 | A | 12/1994 |
| JP | 4089099 | | 3/1999 |
| WO | WO 95/32330 | | 11/1995 |
| WO | WO 00/75413 | A1 | 12/2000 |

* cited by examiner

COMBINATION TUMBLE AND CABINET DRYER

BACKGROUND OF THE INVENTION

In the United States, clothes dryers typically include a rotatable drum in which wet clothes are tumbled as hot air is passed through the drum to remove moisture from the clothes. Drying cabinets are also known in the art, though are more popular in Japan than in the United States. Drying cabinets provide hot air for drying clothes hanging in the cabinet. Drying cabinets can also be used for de-wrinkling clothes by providing steam into the cabinet to remove wrinkles.

It has also been known to position a cabinet dryer adjacent a tumble dryer and connect an air duct from the tumble dryer to the cabinet dryer so as to direct the hot air from the tumble dryer to the cabinet dryer. However, the cabinet dryer cannot be operated independently of the tumble dryer in such a set up.

Accordingly, a primary objective of the present invention is the provision of an improved combination tumble and cabinet dryer.

Another objective of the present invention is the provision of a combination tumble and cabinet dryer wherein the tumble and cabinet dryers can be operated independently of one another.

A further objective of the present invention is the provision of a clothes drying appliance having both a tumble dryer and a cabinet dryer housed within a cabinet so as to define a single portable unit.

Still another objective of the present invention is the provision of a clothes drying appliance with a tumble dryer and a cabinet dryer, with independent sources of hot air for each of the dryers.

Yet another objective of the present invention is the provision of a combination tumble and cabinet dryer wherein the cabinet dryer includes a shelf area and a hanging area.

Another objective of the present invention is the provision of a combination tumble and cabinet dryer wherein the cabinet dryer extends along one side of the tumble dryer.

These and other objectives will become apparent from the following description of the invention.

SUMMARY OF THE INVENTION

A combination tumble and cabinet dryer is provided wherein the tumble dryer and cabinet dryer are operable independently of one another. The tumble dryer is operatively mounted within a cabinet. A liner in the cabinet defines a cabinet dryer within the cabinet. The cabinet dryer extends over and along one side of the tumble dryer. Separate first and second sources of heated air are provided for the tumble dryer and cabinet dryer, respectively. The cabinet dryer includes a shelf area with removable shelves and a hanging area for receiving clothes on hangers. A portion of the cabinet dryer extends substantially along the height of the cabinet wherein long clothes, such as dresses, can be hung for drying. Steam may also be provided to the cabinet dryer for de-wrinkling of clothes.

DETAILED DESCRIPTION OF THE PREFERRED EMBODIMENT

Figure 1:
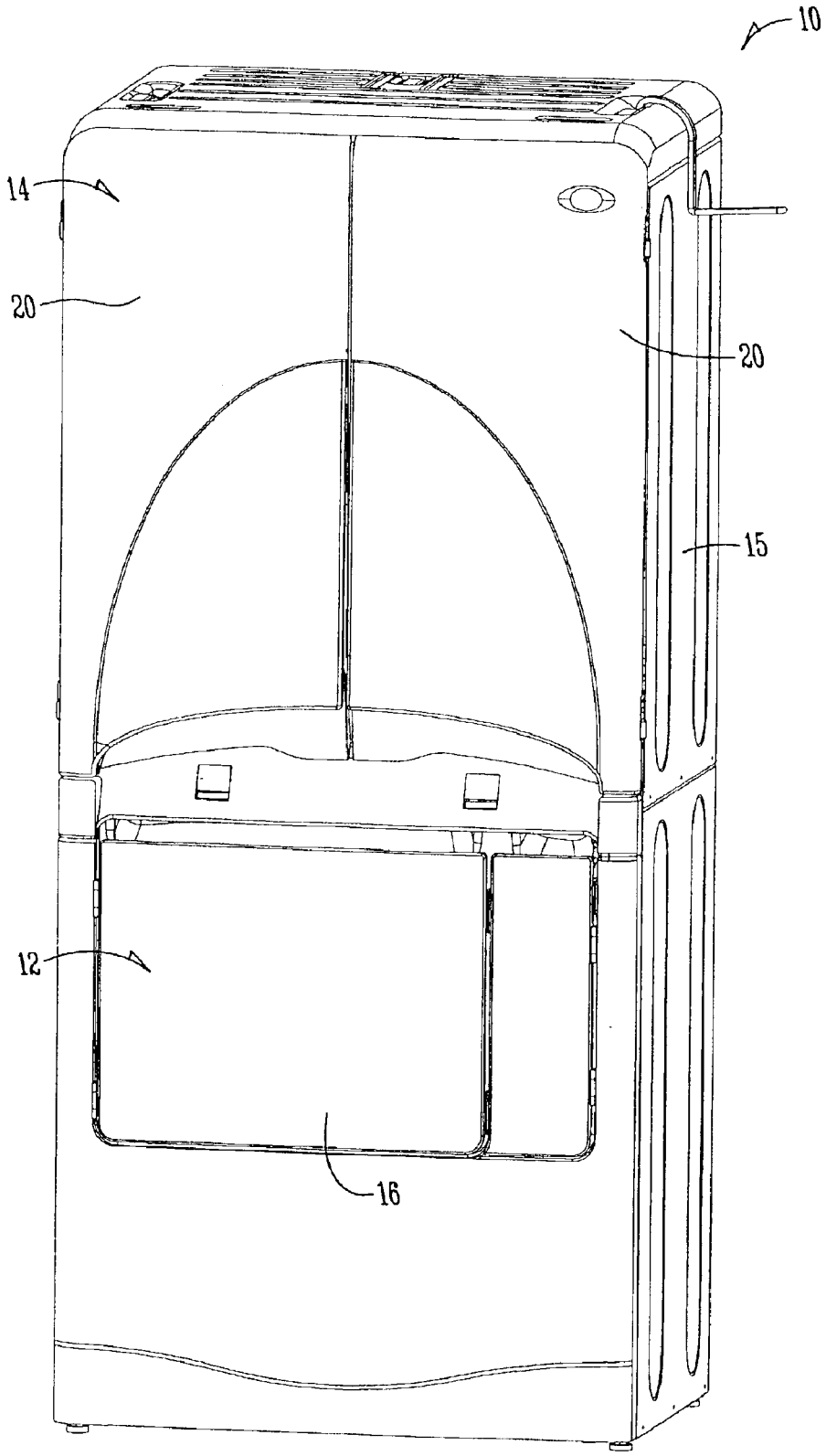
FIG. 1 is a perspective view of a combination tumble and cabinet dryer according to the present invention, with the doors closed.

FIG. 1 shows a combination clothes drying machine 10 having a tumble dryer 12 and a drying cabinet 14. The tumble dryer 12 and cabinet dryer 14 are housed within a cabinet or housing 15 so as to define a single appliance with dual functions. The drying cabinet 14 is shown to be mounted on top of the tumble dryer 12, though it is understood that other configurations can be provided. The tumble dryer 12 includes a door 16 so as to provide access to the rotatable drum 18.

Figure 2:
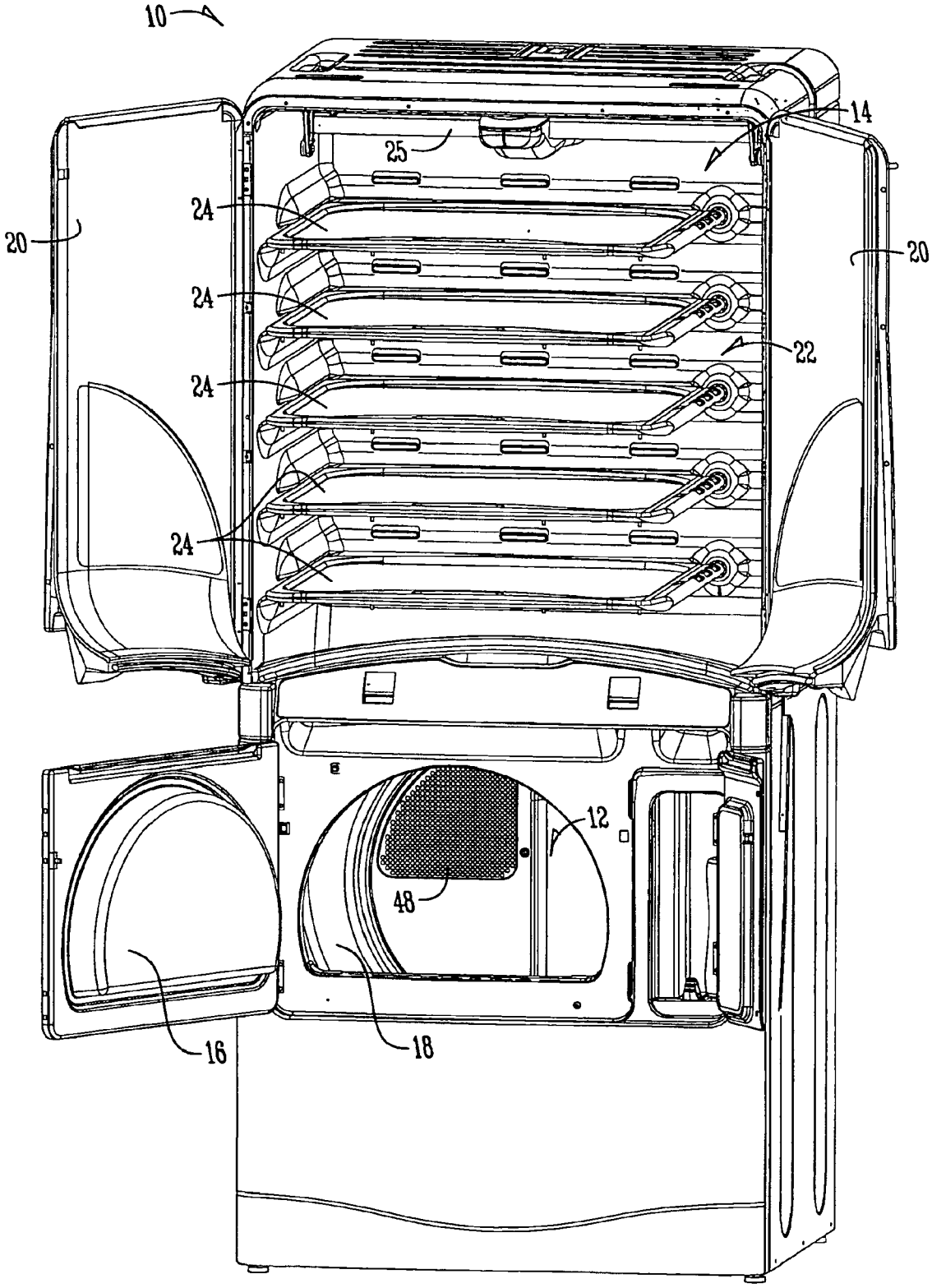
FIG. 2 is a view similar to FIG. 1 showing the doors open.
Figure 3:
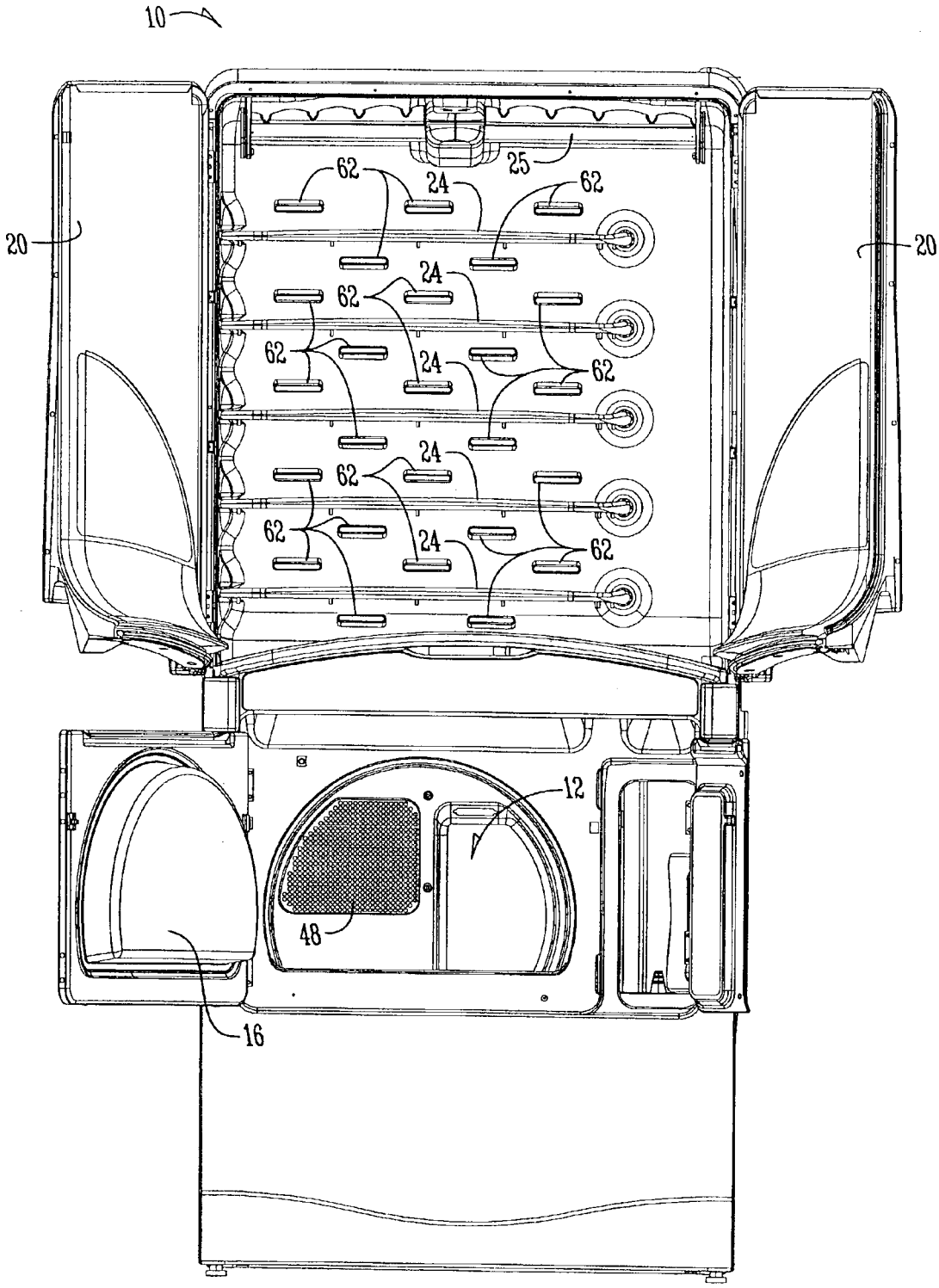
FIG. 3 is a front elevation view of the appliance with the doors open.

The drying cabinet 14 includes a pair of doors 20 which provide access to a drying compartment 22. As seen in FIG. 2, the compartment 22 may include removable shelves 24, which preferably have a mesh support surface so that air can circulate therethrough, and a hanging bar 25 to hold clothes on hangers.

Figure 4:
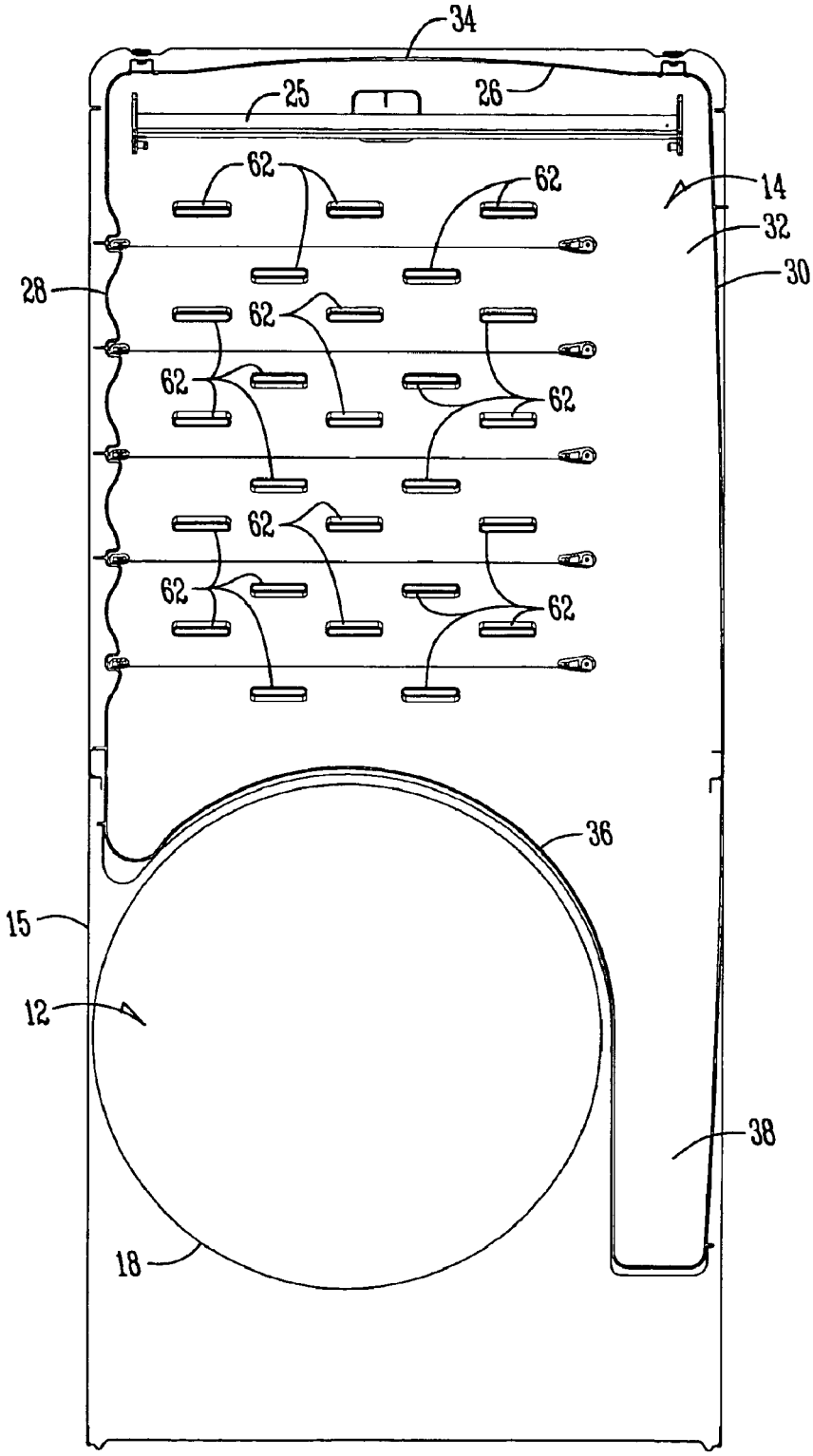
FIG. 4 is a front elevation schematic view showing the orientation of the tumble dryer and the cabinet dryer within the cabinet of the appliance.

The compartment 22 is formed by a liner 26, best shown in FIG. 4. The liner 26 includes opposite side walls 28, 30, a rear wall 32, a top wall 34, and a bottom wall 36. The bottom wall 36 has a curved profile so as to extend around the drum 18 of the tumble dryer 12. The compartment 22 includes an elongated portion 38 adapted to receive long hanging items for drying, such as a dress. Thus, the cabinet dryer 14 includes a shelf area and a hanging area. It is understood that the shelves 24 can be removed so that clothes on hangers can be supported by the hanging bar 25 substantially across the width of the cabinet dryer 14.

Figure 5:
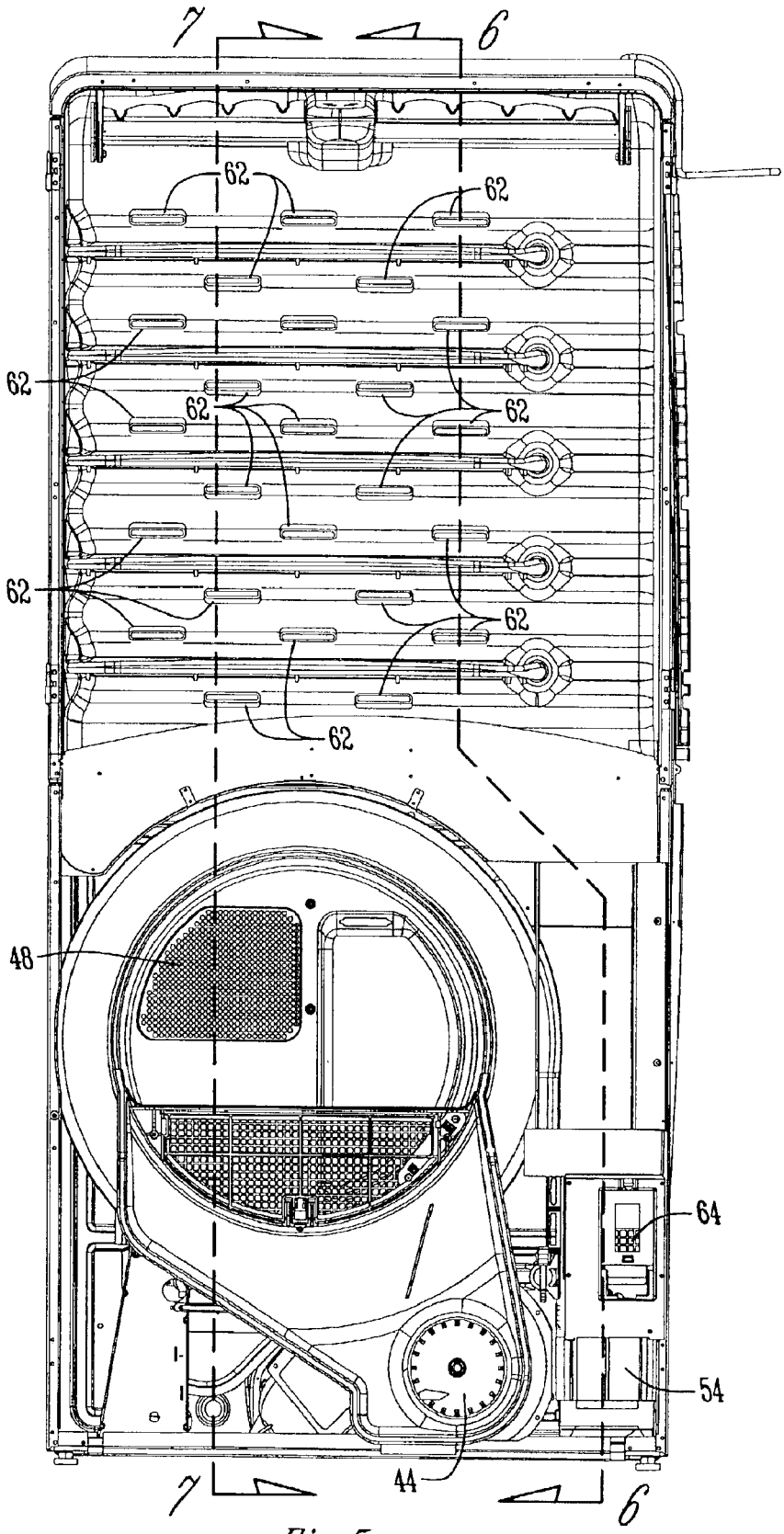
FIG. 5 is a front elevation view of the dryer with the front panels and doors removed.
Figure 6:
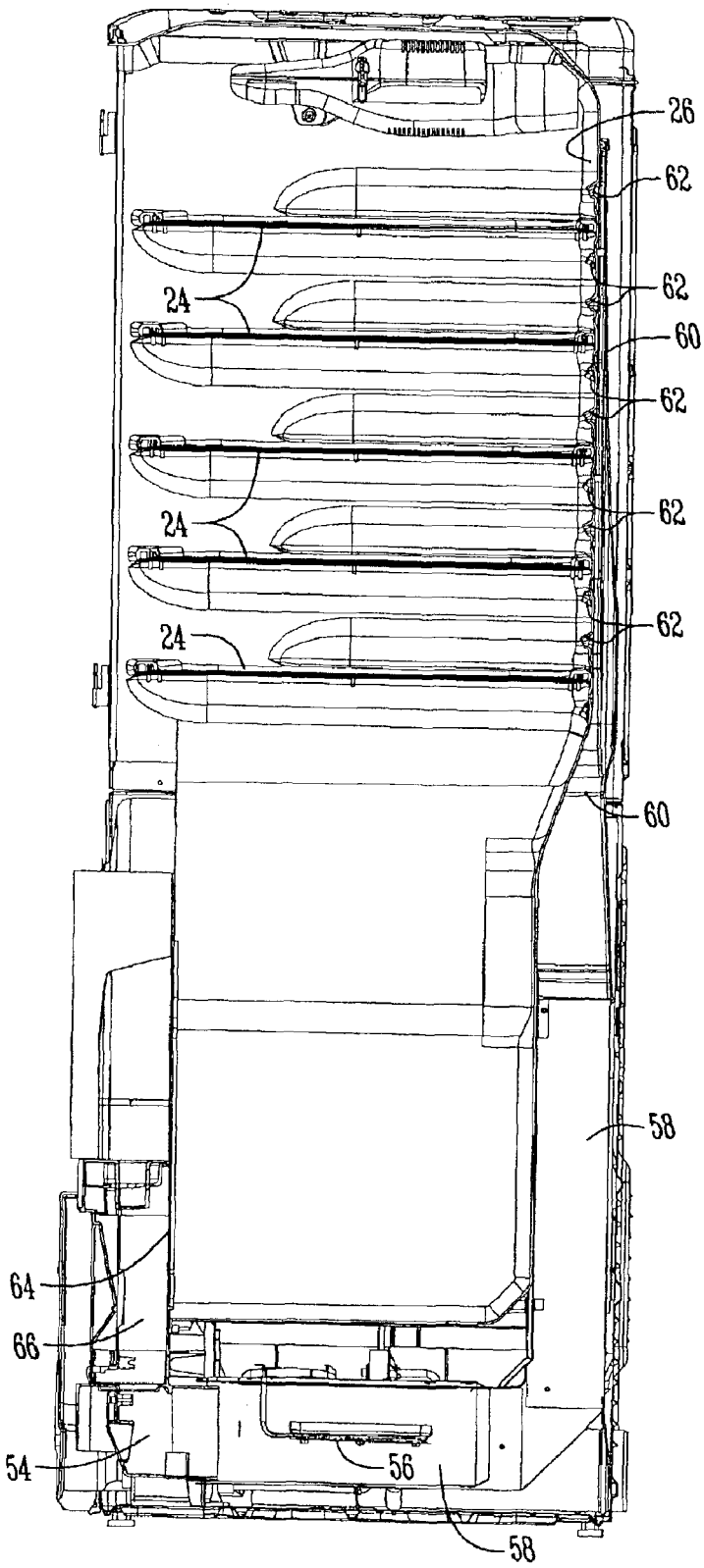
FIG. 6 is a sectional view taken along lines 6—6 of FIG. 5.
Figure 7:
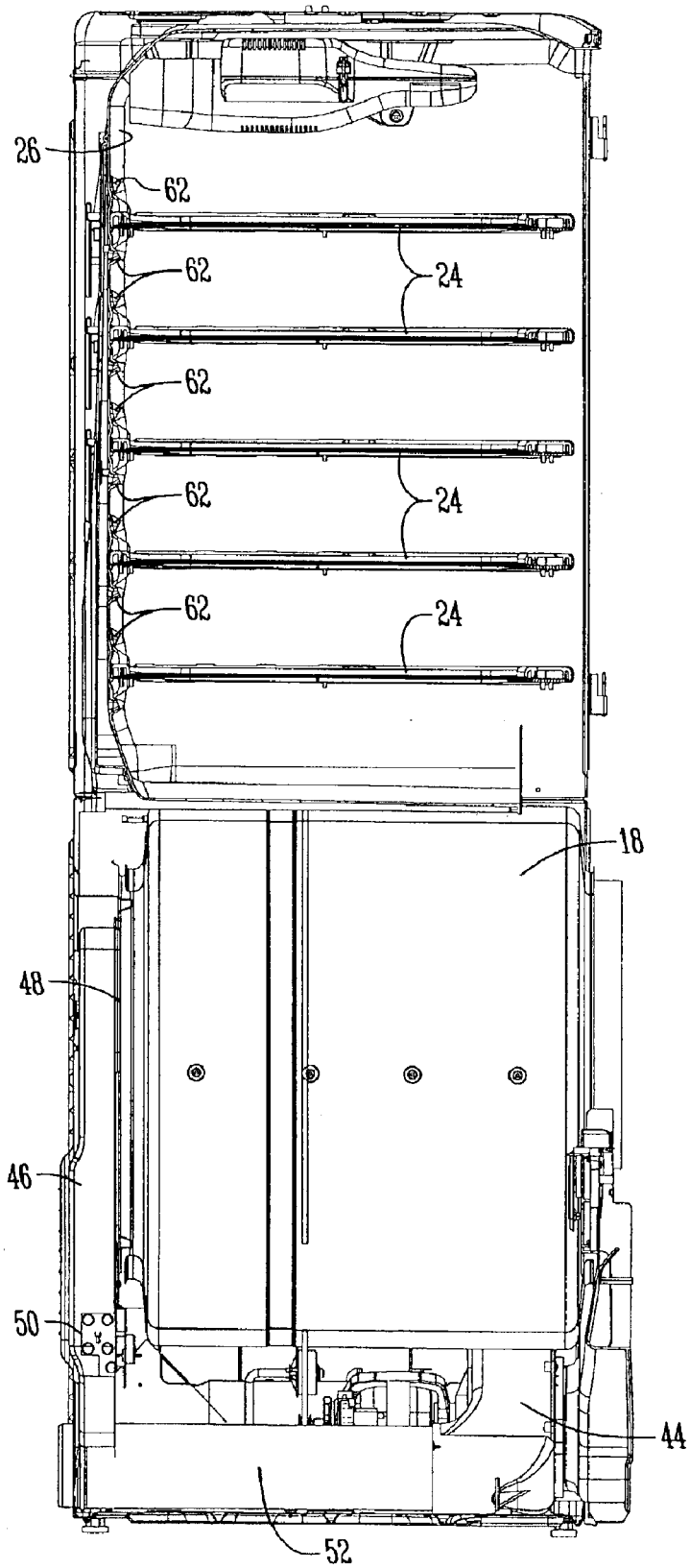
FIG. 7 is a sectional view taken along lines 7—7 of FIG. 5.

FIGS. 5–7 show the independent hot air systems for the tumble dryer 12 and cabinet dryer 14. More particularly, the hot air supply system for the tumble dryer 12 includes a blower 44 which draws air through a rear duct 46 for introduction into the drum 18 via an inlet grid 48. An air heater 50 is provided in the duct 46 for heating the air before introduction through the grid 48. The heated air is pulled through the tumbling clothes load to the blower 44. Then the air is forced out of the tumble dryer 12 via an exhaust duct 52.

The hot air supply system for the cabinet dryer 14 includes a blower 54 which forces air past a heater and steamer unit 56 in an inlet duct 58. The duct 58 leads to a plenum 60 extending behind the cabinet dryer and substantially across the width thereof. The hot air is directed from the plenum 60 through a plurality of air nozzles 62 in the back wall of the cabinet dryer 14 to dry articles hanging on the bar 25 or sitting upon the shelves 24. The cabinet dryer 14 includes an air return grid 64 connected to a duct 66 which can alternatively recycle air back through the blower 54 or exhaust the air to the atmosphere. Details of the air plenum 60 and nozzles 62 are described in Applicant's co-pending application U.S. Ser. No. 10/361,896 filed on Feb. 10, 2003, and incorporated herein by reference.

The combination tumble and cabinet dryer appliance 10 includes controls to separately operate the independent hot air supply systems for either or both of the tumble and cabinet dryers 12, 14. Accordingly, the tumble dryer 12 and the cabinet dryer 14 can be operated independently of one another, either simultaneously or one at a time.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A clothes drying appliance, comprising:

a housing;

a tumble dryer within the housing;

a cabinet dryer within the housing, wherein the cabinet dryer is defined by a liner within the housing; and the tumble dryer and cabinet dryer being arranged one above the other and being operable independently of one another.

2. The appliance of claim 1 further comprising a first source of heated air for the tumble dryer and a second source of heated air for the cabinet dryer.

3. The appliance of claim 1 further comprising independent heated air supplies for the tumble and cabinet dryers.

4. The appliance of claim 1 wherein the cabinet dryer extends over and along one side of the tumble dryer.

5. The appliance of claim 1 wherein a portion of the cabinet dryer extends along one side of the tumble dryer.

6. The appliance of claim 1 wherein a portion of the cabinet dryer extends substantially along the height of the housing.

7. The appliance of claim 1 further comprising removable shelves.

8. The appliance of claim 1 wherein the cabinet dryer includes a shelf area and a hanging area.

9. The appliance of claim 1 further comprising shelves in the cabinet dryer.

10. The appliance of claim 9 wherein the shelves are removable.

11. The appliance of claim 1 wherein the cabinet dryer includes a curved portion and the tumble dryer is nested within the curved portion.

12. A clothes drying appliance, comprising:

a tumble dryer;

a cabinet dryer;

a housing integrally enclosing both the tumble and cabinet dryers;

the cabinet dryer being defined by a liner within the housing;

the tumble and cabinet dryers being arranged one above the other; and independent first and second sources of hot air for the tumble and cabinet dryers.

13. The appliance of claim 12 wherein a portion of the cabinet dryer extends substantially along the height of the housing.

14. The appliance of claim 12 wherein the liner extends partially around the tumble dryer.

15. The appliance of claim 12 wherein the cabinet dryer extends over and along one side of the tumble dryer.

16. The appliance of claim 12 wherein a portion of the cabinet dryer extends along one side of the tumble dryer.

17. The appliance of claim 12 wherein the cabinet dryer includes a shelf area and a hanging area.

18. The appliance of claim 12 further comprising shelves in the cabinet dryer.

19. The appliance of claim 12 wherein the cabinet dryer includes a curved portion and the tumble dryer is nested within the curved portion.

20. A clothes drying appliance, comprising:

a tumble dryer;

a cabinet dryer;

a housing enclosing both the tumble and cabinet dryers so as to define a portable unit; and the cabinet dryer being defined by a liner within the housing.

21. The appliance of claim 20 further comprising independent heated air supplies for the tumble and cabinet dryers.

22. The appliance of claim 20 wherein the cabinet dryer extends over and along one side of the tumble dryer.

23. The appliance of claim 20 wherein a portion of the cabinet dryer extends along one side of the tumble dryer.

24. The appliance of claim 20 wherein a portion of the cabinet dryer extends substantially along the height of the housing.

25. The appliance of claim 20 wherein the cabinet dryer includes a hanging area.

26. The appliance of claim 20 wherein the liner extends partially around the tumble dryer.

27. The appliance of claim 20 further comprising shelves in the cabinet dryer.

28. The appliance of claim 20 wherein the cabinet dryer includes a curved portion and the tumble dryer is nested within the curved portion.

29. The appliance of claim 27 wherein the shelves are removable.

* * * * *